United States Patent [19]

Watanabe

[11] Patent Number: 4,949,638

[45] Date of Patent: Aug. 21, 1990

[54] PRINTER USING A DRUM

[75] Inventor: Tetsuo Watanabe, Tokyo, Japan

[73] Assignee: Ricoh Company, Ltd., Tokyo, Japan

[21] Appl. No.: 349,083

[22] Filed: May 9, 1989

[30] Foreign Application Priority Data

May 9, 1988 [JP] Japan ..... 63-60702
Mar. 6, 1989 [JP] Japan ..... 1-53173

[51] Int. Cl.[5] ..... B41F 1/30
[52] U.S. Cl. ..... 101/409; 400/185
[58] Field of Search ..... 400/185, 187, 120, 624, 400/625; 101/407–410

[56] References Cited

U.S. PATENT DOCUMENTS 4,625,218 11/1986 Watanabe ..... 400/120
4,627,754 12/1986 Sholtis et al. ..... 400/649
4,679,953 7/1987 Sone et al. ..... 400/625
4,752,786 6/1988 Inoue et al. ..... 400/120
4,829,320 5/1989 Une et al. ..... 400/120

FOREIGN PATENT DOCUMENTS 6112380 1/1986 Japan ..... 400/185
116570 6/1986 Japan ..... 400/187

*Primary Examiner*—Edgar S. Burr
*Assistant Examiner*—Ren Yan
*Attorney, Agent, or Firm*—Oblon, Spivak, McClelland, Maier & Neustadt

[57] ABSTRACT

A printer for printing out information on a paper wound around a drum and having a device for feeding and discharging a paper sheet from the drum and a clamping pawl which is provided on the drum to selectively clamp and unclamp the leading edge of the paper sheet. The paper feed and discharge and the clamping and unclamping of a paper sheet performed by the feeding and discharging device and the clamping pawl, respectively, are implemented by a single reversible stepping motor, clutches which are disposed in gearings which individually transmit the rotation of the stepping motor to the paper feeding and discharging device and the clamping pawl.

4 Claims, 3 Drawing Sheets

PRINTER USING A DRUM

BACKGROUND OF THE INVENTION

The present invention relates to a thermal transfer printer, ink jet printer or similar printer of the type using a drum around which a paper sheet is to be wound for printing out information thereon.

While a prerequisite with office automation equipment is that it features advanced functions, such equipment has to be small in size and also low in cost. Miniaturization is also an important consideration with a printer of the type using a drum which belongs to a family of office automation equipment, and various studies and improvements have heretofore been reported.

Some of the printers of the type described are provided with a clamper in the form of a pawl for clamping a paper around the drum. A drawback with this kind of prior art printer is that two exclusive stepping motors are required, one for feeding and discharging a paper and the other for opening and closing the clamper, and an electromagnetic clutch has to be associated with each of the motors. This is a critical obstruction to the miniaturization of the printer. Moreover, these stepping motors and electromagnetic clutches and therefore the printer as a whole is expensive.

SUMMARY OF THE INVENTION

It is therefore an object of the present invention to provide an inexpensive and small-size printer using a drum.

It is another object of the present invention to provide a generally improved printer using a drum.

A printer for printing out information on a paper sheet which is wound around a drum of the printer of the present invention comprises a paper feeding and discharging device for feeding and discharging the paper sheet, a clamping pawl provided on the outer periphery of the drum for selectively clamping and unclamping a leading edge of the paper sheet on the drum, a single motor selectively rotatable in a forward and a reverse direction, a first and a second gearing for transmitting the rotation of the single motor to the paper feeding and discharging device and the clamping means, respectively, and first and second clutches respectively associated with the first gearing and the second gearing for causing, when the single motor is rotated in any of the forward and reverse directions, either one of the first gearing and the second gearing to transmit the rotation of the motor.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
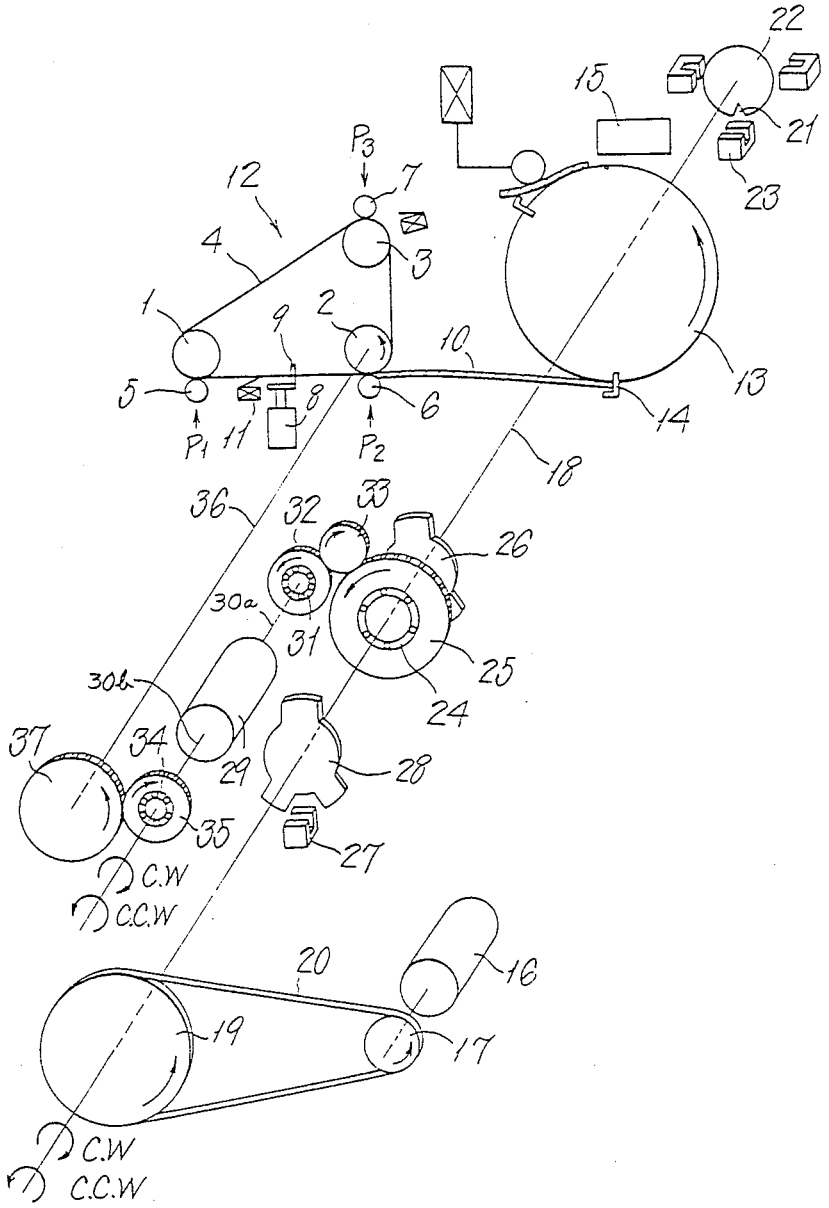
FIG. 1 is an exploded perspective view of a printer using a drum embodying the present invention.

Referring to FIG. 1 of the drawings, a printer using a drum embodying the present invention is shown and includes a paper feeding and discharging device 12. The paper feeding and discharging device 12 has a feed roller 1, a drive roller 2, and a discharge roller 3 which are located at predetermined distances from one another. A timing belt 4 is passed over the rollers 1, 2 and 3. Auxiliary rollers 5, 6 and 7 are operatively associated with the rollers 1, 2 and 3, respectively. A register pawl 9 is operated by a plunger 8 to move into and out of a paper transport path defined between the rollers 1 and 2. A paper sensor 11 is responsive to a paper sheet 10 which is inserted in the roller 1 section, delivering an operation command to the plunger 8 and other actuators (not shown). The paper feeding and discharging device 12 is located ahead of a drum 13 with respect to the intended direction of paper feed. In operation, the paper sheet 10 coming in through the feed roller 1 section is transported via the driver roller 2 section to be clamped by a pawl holder (clamp pawl) 14 which is provided on the outer periphery of the drum 13. As the drum 13 is rotated counterclockwise as viewed in FIG. 1, information is printed out by a thermal head 15 on the paper sheet 10 being moved together with the drum 13. Then, the paper or printing 10 is discharged via the discharge roller 3 section. In the thermal printer of the type using a drum shown in FIG. 1, the drive of the paper feeding and discharging device 12 and the opening and closing of the pawl holder 14 are implemented with a single stepping motor which is rotatable in forward and reverse directions. Pressing forces $P_1$, $P_2$ and $P_3$ acting between the rollers 1, 2 and 3 and their associated auxiliary rollers 5, 6 and 7, respectively, are related as $P_1<P_2$ and $P_1<P_3$. The pressing force $P_1$ is so selected as to allow the paper sheet 10 to be inserted by hand as far as the register pawl 9.

In detail, a stepping motor 16 adapted to drive the drum 13 has an output shaft on which a pulley 17 is mounted, while a pulley 19 is mounted on a drum shaft 18. A belt 20 is passed over the pulleys 17 and 19 so that the rotation of the motor 16 may be transmitted to the drum 13 by way of the pulley, 17, belt 20, pulley 19 and drum shaft 18. A disk 22 is mounted on the other end of the drum shaft 18 and provided with a notch 21 in a part of its circumferential edge. An arrangement is made such that when a home position sensor 23 senses the notch 21 of the disk 22, the drum 13 is brought to and held in a halt at its home position. In this particular embodiment, the words "home position" refers to a position where the pawl holder 14 provided on the outer periphery of the drum 13 is located at the lowermost position.

A driven gear 25 is mounted on the drum shaft 18 adjacent to the pulley 19. A one-way clutch 24 is press-fitted in the driven gear 25 and lockable in response to only the counterclockwise rotation of the drum 13. A cam 26 is mounted on the drum shaft 18 at one side of the driven gear 25 and has a profile which includes equally spaced projections and equally spaced recesses. The cam 26 has a top dead point and a bottom dead point for, respectively, opening and closing the pawl holder 14. The words "top dead point" refer to a position in which a cam follower which will be described rides on any of the projections, and the words "bottom dead point" refer to a position in which the cam follower falls in any of the recesses.

The mechanism for opening and closing the pawl holder 14 is as follows.

Figure 2:
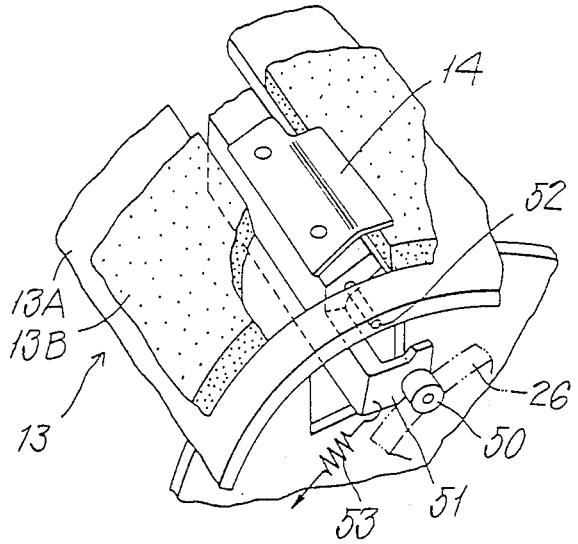
FIG. 2 is a fragmentary perspective view showing a pawl holder which is included in the printer of FIG. 1.

As shown in FIG. 2, a cam follower 50 is rotatably mounted on an arm 51. The arm 51 in turn is rotatably connected at its intermediate portion to the end of a hallow cylindrical portion 13A by a shaft 52. The hollow cylindrical portion 13A which is made of metal constitutes the drum 13 together with a rubber layer 13B that is provided on the cylindrical portion 13A for the convenience of printing. A tension spring 53 is anchored to one end of the arm 51 to constantly bias the latter such that the cam follower 50 remains in pressing contact with the cam 26, i.e., such that the pawl holder 14 tends to remain in a closed position. In this configuration, the pawl holder 14 is open when the cam follower 50 is in the top dead point and closed when the cam follower 50 is in the bottom dead point.

Referring again to FIG. 1, a timing disk 28 is mounted on the drum shaft 18 at the other side of the driven gear 25. A sensor 27 is responsive to the position of the timing disk 28 and therefore the position of the cam 26. While the driven gear 25 is rotated by a drive gear which will be described, the cam 26 and timing disk 28 are rotated integrally with the driven gear 25. The rotation of the driven gear 25 is controlled in response to an output of the sensor 27 which senses the varying position of the timing disk 28 in terms of the shifts between equally spaced projections and recesses provided on the outer periphery of the timing disk 28.

Another stepping motor 29 is located in close proximity to and in parallel with the drum shaft 18. Shafts **30*a* and 30*b* individually extend from opposite ends of the stepping motor 29. A one-way clutch 31 is mounted on the shaft 30*a* and lockable in response to only the counterclockwise rotation of the motor 29. A drive gear 32 is mounted on the shaft 30*a* through the one-way clutch 31. The drive gear 32 is held in mesh with an intermediate idle gear 33 which in turn is held in mesh with the driven gear 25, whereby the rotation of the drive gear 32 is transmitted to the driven gear 25 by the idle gear 33. Mounted on the other shaft 30*b* of the stepping motor 29 is a drive gear 35 in which a one-way clutch 34 is press-fitted. The one-way clutch 34 is lockable in response to only the clockwise direction of the motor 29. The drive gear 35 is meshed with a driven gear 37 which is mounted on a shaft 36 on which the drive roller 2 is mounted. By such a gearing, when the steping motor 29 is rotated clockwise, the drive roller 2 is rotated via the intermeshing drive gear 35 and driven gear 37 resulting in the rollers 1, 2, 3, 5 and 6 of the paper feeding and discharging device 12 being driven through the timing belt 4**.

Assume that the paper sheet 10 is inserted into the paper feeding and discharging device 12 via the feed roller 1 section for printing out information thereon. The movement of the paper 10 is stopped when its leading edge abuts against the register pawl 9. The paper sensor 11 senses the paper 10 so that the stepping motor 29 is caused to rotate in a clockwise direction rotation. The rotation of the motor 29 is transmitted to the drive roller 2 by way of the drive gear 35, driven gear 37 and shaft 36, so that the rollers 1, 2 and 3 are driven in a rotary motion timed to the timing belt 4. The timing belt 4 transports the paper sheet 10 until the leading edge of the sheet 10 abuts against the register pawl 9. After the paper sheet 10 has been fully brought into register, the plunger 8 is contracted to retract the register pawl 9 out of the paper transport path. The paper sheet 10 is then further driven by the timing belt 4 toward the pawl holder 14 of the drum 13 which is held in the home position. Such a movement of the paper sheet 10 is effected on the basis of the controlled stepwise movement of the stepping motor 29. While the stepping motor 29 is rotated in the clockwise direction as stated above, the drive gear 32 simply idles relative to the shaft **30*a* and does not rotate due to the operation of the one-way clutch 31** associated therewith.

When the leading edge of the paper sheet 10 abuts against the pawl holder 14, the stepping motor 29 is rotated counterclockwise to cause the drive gear 32 into rotation. The rotation of the drive gear 32 is transmitted to the driven gear 25 by the intermediate idle gear 33 and the driven gear 25 and the cam 26 mounted on the driven gear 25 are rotated in the counterclockwise direction. In this instance, the driven gear 35 simply idles relative to the shaft **30*b* due to the operation of the one-way clutch 34. At the instant when the cam 26 is rotated from the top dead point to the bottom dead point, the pawl holder 14 is closed to clamp the leading edge of the paper sheet 10**.

As the sensor 27 senses that the pawl holder 14 has clamped the leading edge of paper sheet 10 in terms of the displacement of the timing disk 28, the stepping motor 29 is deenergized and then the other stepping motor 16 is driven counterclockwise. In response, the drum 13 is rotated counterclockwise via the pulley 17, belt 20, pulley 19, and drum shaft 18. Since the driven gear 25 is rotated integrally with the drum shaft 18, the cam 26 is also rotated while remaining in its top dead point relative to the pawl holder 14. The pawl holder 14 therefore continuously clamps the paper sheet 10 despite the rotation of the drum 13, so that the sheet 10 is transported by the drum 13 being rotated. In this condition, information is printed out on the paper sheet 10 by the thermal head 15. After the information has been printed out on the paper sheet 10, the stepping motor 16 is rotated in the counterclockwise direction to cause the drum 13 into rotation in the same counterclockwise direction. As the drum 13 is rotated, the pawl holder 14 is moved to its sheet discharge position near the discharge roller section 3. When a sheet discharge position sensor 40 senses the notch 21 of the disk 22, the pawl holder 14 is stopped at the sheet discharge position. Then, the drum 13 is held at the sheet discharge position by means of deenergization of the stepping motor 16. After stoppage of the pawl holder 14 at the sheet discharge position, the stepping motor 29 is rotated in the counterclockwise direction to cause the driven gear 25 into rotation by way of the gear 33 in the counterclockwise direction, so that the cam 26 and timing disk 28 is rotated integrally with the driven gear 25 and the pawl holder 14 is open when the cam follower 50 is in the top dead point. The position of the timing disk 28 is sensed by the sensor 27. When a solenoid 41 is energized, a roller 42 mounted on a plunger 43 of the solenoid 40 presses the paper sheet 10 against the surface of the drum 13. The drum with the paper sheet 10 pressed by the roller 42 is rotated in the counterclockwise direction, so that the leading edge of the paper sheet 10 is moved to the discharge roller section 3. When a microswitch 44 provided near the discharge roller section 3 is responsive to the paper sheet 10, the stepping motor 29 is rotated clockwise as in the paper feeding operation resulting in the paper sheet 10 being discharged via the discharge roller 3 section.

As stated above, the paper 10 is fed and discharged and clamped and unclamped on the drum 13 by a single reversible stepping motor 29 and mechanical one-way clutches. This eliminates the need for two independent stepping motors and electromagnetic clutches otherwise individually assigned to such two different kinds of operations.

With the illustrative embodiment, it may still occur that the pawl holder 14 fails to be completely opened or completely closed. Especially, an incomplete closed position of the pawl holder 14 is critical. Hereinafter will be described the cause of incomplete closing of the pawl holder 14 and some countermeasures against such an occurrence.

The sensor 27 is constituted by a light emitting element and a light-sensitive element. Before the paper sensor 11 senses the paper sheet 10, the timing disk 28 is positioned such that any of its recesses faces the sensor 27 and therefore light issuing from the light emitting element of the sensor 27 is incident to the light-sensitive element. As soon as the sensor 27 senses the paper sheet 10 being inserted, the pulse motor 29 and therefore the timing disk 28 starts rotating with the result that the light issuing from the light emitting element of the sensor 27 is intercepted by the projection of the timing disk 28. In response to the resulting change in the output of the sensor 27, a control system (not shown) stops the rotation of the stepping motor 29. In this manner, when the projection to the timing disk 28 interrupts the optical path of the sensor 27, the stepping motor 29 is deenergized and, at this time, the cam 26 assumes the top dead point, more specifically the intermediate point of the projection. In this condition, the pawl holder 14 is open. When the leading edge of the paper 10 abuts against the pawl holder 14, the stepping motor 29 is energized to rotate the driven gear 25 counterclockwise resulting in a shift of the cam follower 50 from the top dead point (projection) to the bottom dead point (recess). This causes the pawl holder 14 to close and thereby to clamp the leading edge of the paper 10. This clamping state of pawl holder 14 is maintained constant while the cam follower 50 lies in the recess of the cam 26. In the illustrative embodiment, it is considered ideal that when the cam follower 50 reaches the intermediate point of the recess, the projection of the timing disk 28 is brought out of the optical path of the sensor 27 and, in response to the resulting output of the sensor 27, the stepping motor 29 is deenergized. In fact, this particular embodiment is constructed and arranged to fulfill such an ideal condition.

However, assume that a substantial degree of counterclockwise inertia acts on the drum shaft 18. Then, despite that the projection of the timing disk 28 has moved away from the sensor 27 and therefore the stepping motor 29 has been brought to a stop, the inertia is apt to cause the cam follower 50 to fall along the downgoing locus of the cam 26 and then move beyond the intermediate point of the subsequent recess to a certain indefinite point on the following up-going locus without stopping at the intermediate point of the recess. This stems from the fact that the one-way clutch 32 is incapable of restraining the driven gear 25 from rotating counterclockwise.

Once the relationship between the cam 26 and the cam follower 50 is disturbed with respect to the rotating direction, the pawl holder 14 fails to assume a fully closed position and therefore to clamp the paper sheet 10 by a sufficient force. Should information be printed out on the paper sheet 10 in such a condition, dots on the paper sheet 10 would be disturbed in position due to the dislocation of the paper sheet 10 relative to the drum surface. Especially, when a composite color image is to be formed by transferring images of three primary colors by three consecutive rotations of the drum 3, the dislocation of the paper 10 would make it extremely difficult to render the colors due to non-register.

Figure 3:
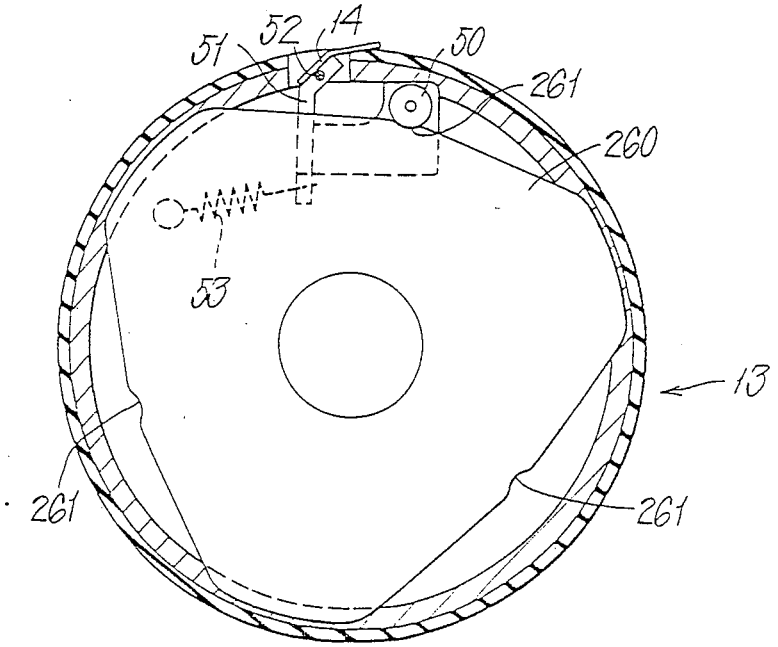
FIGS. 3 and 4 are views showing a modification to the embodiment shown in FIG. 1.
Figure 4:
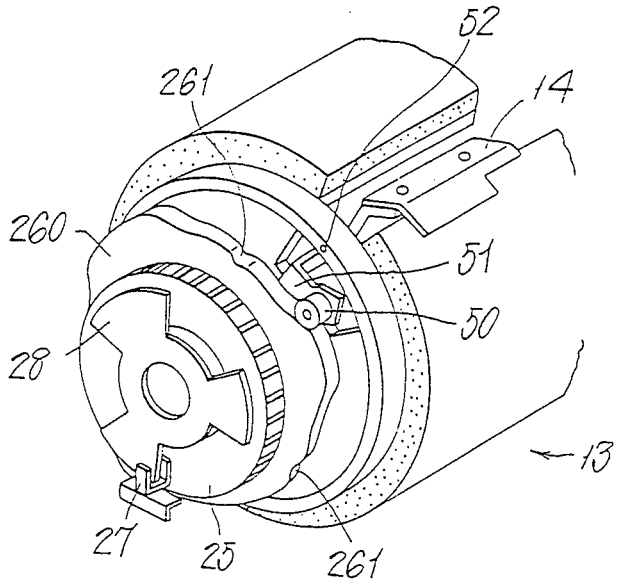

FIGS. 3 and 4 shows a first possible implementation to insure the closed position of the pawl holder 14. As shown, the cam 260 is provided with a dint 261 at the intermediate point of each recess for catching the cam follower 50 by a click-stop action. In this case, the position of the timing disk 28 should preferably be selected such that a command for stopping the rotation of the stepping motor 29 appears slightly before the dint 261 reaches the cam follower 50. This is because click-stopping the cam follower 50 at the instant when the inertia is reduced to an adequate degree is advantageous. In this configuration, the cam 260 is successfully caught by the cam follower 50 without overrunning in response to a command from the timing disk 28. This allows the pawl holder 14 to clamp the paper sheet 10 accurately in its closed position, thereby eliminating the dislocation of the paper 10.

An alternative implementation is to provide in each recess of the cam 26 a material which restrains the rolling motion of the cam follower 50 and thereby inhibits the cam 26 from overrunning in the event of a transition from the open position to the closed position of the pawl holder 14, while using the one-way clutch 34 and drive roller 35 and the one-way clutch 31 and drive gear 32 of FIG. 1 in the illustrated configuration. The above-mentioned material may advantageously be implemented by urethan, chloroprene or similar rubber material which is softened to a hardness of 30 degrees or foamed to a low degree. This kind of material is formed in a sheet configuration and adhered to the predetermined portions of the cam 26. The elasticity of such a material lowers the rollability of the cam follower 50 to thereby prevent the cam 26 from overrunning.

Figure 5:
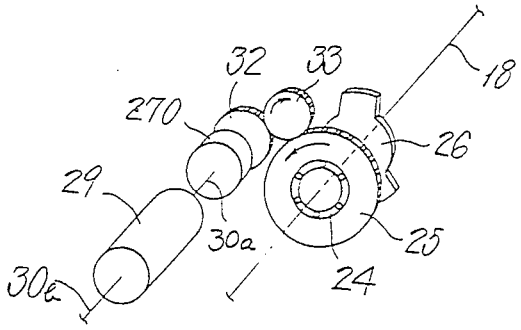
FIG. 5 is a view showing an alternative arrangement in which one-way clutch is replaced with an electromagnetic clutch.

Another alternative implementation is to eliminate the overrun of the cam 26 ascribable to the function particular to the one-way clutch 31, i.e., to use an electromagnetic clutch which substantially replaces the one-way clutch 31 with respect to the function. Specifically, as shown in FIG. 5, an electromagnetic clutch 270 is interposed between the shaft **30*a* and the drive gear 32. When the rotation of the stepping motor 29 is to be transmitted to the drive gear 32, the electromagnetic clutch 270 is energized to set up the operative connection of the shaft 30*a* and drive gear 32 and, when the rotation is not to be transmitted, the clutch 270 is deenergized to render the shaft 30 freely rotatable. While the pawl holder 14 is in the closed position, the cam 26 is continuously rotated by the stepping motor 29 until detected by the timing disk 28 and sensor 27. As the sensor 27 senses the cam 26, the motor 29 is braked so that the cam 26 is surely prevented from overrunning. After the pawl holder 14 has been brought to the closed position, the clutch 270 is deenergized to allow information to be printed out on the paper sheet 10**.

In summary, it will be seen that the present invention provides a printer in which the feed and discharge of a paper sheet and the clamping and unclamping of the paper on a drum are implemented by the reversible rotation of a single stepping motor, and clutches. This kind of printer is therefore far more inexpensive and miniature than the prior art printer of the type using a drum.

Various modifications will become possible for those skilled in the art after receiving the teachings of the present disclosure without departing from the scope thereof. For example, while the present invention has been shown and described in relation to a printer using a drum, it is similarly applicable to the paper feeding and discharging mechanism of a drum type scanner.

What is claimed is:

1. A printer for printing out information on a paper sheet which is wound around a drum of said printer, comprising;

paper feeding and discharging means for feeding and discharging the paper sheet;

clamping means provided on an outer periphery of the drum for selectively clamping and unclamping a leading edge of the paper sheet on the drum;

a single motor selectively rotatable in a forward and a reverse direction;

first and second gearing means for transmitting rotation of said single motor to said paper feeding and discharging means and said clamping means, respectively; and first and second clutch means respectively associated with said first gearing means and said second gearing means for causing, when said single motor is rotated in any of the forward and reverse directions, either one of said first gearing means and second gearing means to transmit the rotation of said motor, wherein said single motor feeds and discharges said paper sheet and selectively clamps and unclamps the leading edge of said paper sheet on the drum.

2. A printer as claimed in claim 1, wherein said motor comprises a stepping motor.

3. A printer as claimed in claim 1, wherein each of said first and second clutch means comprises a one-way clutch.

4. A printer as claimed in claim 1, wherein said first clutch means comprises an electromagnetic clutch.

* * * * *